US007988007B2

(12) United States Patent
Baughman et al.

(10) Patent No.: US 7,988,007 B2
(45) Date of Patent: Aug. 2, 2011

(54) CONTAINER CLOSURE AND CLOSING CAP HAVING CONTOURED BAIL HANDLES

(75) Inventors: Gary M. Baughman, Fremont, IN (US); Lynn A. Brooks, Auburn, IN (US)

(73) Assignee: Rieke Corporation, Auburn, IN (US)

( * ) Notice: Subject to any disclaimer, the term of this patent is extended or adjusted under 35 U.S.C. 154(b) by 1097 days.

(21) Appl. No.: 11/809,129

(22) Filed: May 31, 2007

(65) Prior Publication Data

US 2008/0296301 A1 Dec. 4, 2008

(51) Int. Cl.
*B65D 25/32* (2006.01)
*B65D 25/28* (2006.01)

(52) U.S. Cl. ..... 220/212.5; 215/305; 220/288; 220/755; 220/773

(58) Field of Classification Search ..... 220/289, 220/212.5, 288, 760, 773, 755; 215/305; 222/529

See application file for complete search history.

(56) References Cited

U.S. PATENT DOCUMENTS

| | | | | |
|---|---|---|---|---|
| 2,895,654 | A | 7/1959 | Rieke | |
| 3,804,305 | A | 4/1974 | Rieke | |
| 3,834,597 | A | 9/1974 | Guala | |
| 4,236,629 | A * | 12/1980 | Dwinell | 222/529 |
| 4,413,743 | A | 11/1983 | Summers | |
| 4,422,563 | A * | 12/1983 | Babiol | 222/153.09 |
| 4,618,078 | A * | 10/1986 | Hamman et al. | 222/478 |
| 4,632,282 | A * | 12/1986 | Nagashima | 222/529 |
| 5,004,126 | A * | 4/1991 | Klesius | 222/153.09 |
| D396,380 | S | 7/1998 | Lai et al. | |
| 5,788,100 | A * | 8/1998 | Sturk | 215/258 |
| 5,823,377 | A | 10/1998 | Krautkrämer | |
| 5,941,425 | A * | 8/1999 | Stolz | 222/153.14 |
| 5,950,876 | A | 9/1999 | McLelland | |
| 5,967,376 | A * | 10/1999 | McLelland et al. | 222/153.06 |
| D427,021 | S | 6/2000 | Moran | |
| 6,237,818 | B1 * | 5/2001 | Kline | 222/529 |
| 6,454,137 | B1 * | 9/2002 | Sturk | 222/189.09 |
| D511,457 | S | 11/2005 | Biesecker et al. | |
| 7,717,307 | B2 * | 5/2010 | Baughman et al. | 222/529 |
| 2007/0284398 | A1 * | 12/2007 | Baughman et al. | 222/529 |
| 2007/0284399 | A1 * | 12/2007 | Baughman et al. | 222/529 |

FOREIGN PATENT DOCUMENTS

| | | |
|---|---|---|
| DE | 2 349 467 | 7/1974 |
| EP | 0226 783 A2 | 7/1987 |
| EP | 0675051 A2 | 10/1995 |
| FR | 2 578 819 | 9/1986 |
| GB | 1 277 256 | 7/1972 |

* cited by examiner

*Primary Examiner* — Anthony Stashick
*Assistant Examiner* — Niki M Eloshway
(74) *Attorney, Agent, or Firm* — Woodard Emhardt Moriarty McNett & Henry LLP

(57) ABSTRACT

A unitary threaded closing cap for a closure includes a body having a sidewall and a top panel and at least one bail handle unitarily joined to the top panel wherein the at least one bail handle is arranged in three sections, including an intermediate section and opposing end sections, the intermediate section including a shaped portion that extends above the top panel.

22 Claims, 22 Drawing Sheets

CONTAINER CLOSURE AND CLOSING CAP HAVING CONTOURED BAIL HANDLES

BACKGROUND OF THE INVENTION

The present invention relates in general to container closures and closure assemblies that include a nestable and extendable spout and a threaded closing cap. More specifically, the present invention relates to the construction and arrangement of the threaded closing cap and the lifting (bail) handles that are integrally molded as part of the threaded closing cap. Further, an arcuate band is fabricated as an integral portion of the closing cap that is threadedly assembled to the nestable and extendable spout.

In order to manually lift the spout from a nested position to an extended position, the handles of the closing cap are grasped by the user. As such, the construction and arrangement of the lifting (bail) handles and their relationship to the remainder of the closing cap becomes important. Due to the hinged and pivoting construction and arrangement of the pair of lifting handles, as disclosed herein, these handles are described as "bail handles".

Container closures and closure assemblies of the type generally described herein often include some tamper-evident feature incorporating a plurality of frangible elements. One such product has been offered by Rieke Corporation of Auburn, Ind., under its FLEXSPOUT® trademark. This product includes a tamper-evident cap and a closure body with a nestable and extendable spout. The tamper-evident cap threads onto the threaded end of the spout and the cap must be removed in order to gain access to the contents of the container (drum) via the interior of the spout. In one arrangement, the closure body is received by a raised surrounding (annular) wall that defines the container opening and when used on a metal drum end, the closure includes an annular retaining (ring) member (i.e., retainer) that fits over an outer wall portion of the closure body and, by crimping the metal ring, secures the outer wall portion to the surrounding wall that defines the container opening.

In other arrangements that are suitable for the closure assembly of the present invention, different styles of containers and openings are used. Some closure assembly constructions further include a series of frangible elements that connect a pair of bail handles that are used to extend the spout along with the remainder of the cap. When a plastic drum or container receives a FLEXSPOUT® closure, the tamper-evident cap includes an outer annular portion that snaps over an outer wall portion of the closure body and secures the outer wall portion to the surrounding wall that defines the container opening. A series of frangible elements connects the outer annular portion of the tamper-evident cap with the remainder of the cap body, principally with a pair of bail handles that are used to lift and extend the spout.

Whether the bail handles are interconnected with the remainder of the closing cap by frangible elements or are freely hinged, the shape and positioning of the bail handles is a relevant factor in the overall design. There is a desire to construct and arrange the bail handles so that they can be readily located and easily gasped by the user. Selective shaping or contouring of the bail handles, as well as the overall sizing of the bail handles according to the present disclosure provides ergonomic and functional advantages, as described herein.

Another aspect of the present disclosure pertains to an alternative tamper-evident structure that cooperates with the bail handles. Over the years, as others have tried to imitate the Rieke FLEXSPOUT® closure, the market has provided more choices to consumers, but at a cost. Some of the flexible closing spout imitations do not provide design reliability and predictability. The result is the possibility for some of the tamper-evident frangible elements to be broken at the time of the capping operation. Once customers learn that the frangible elements can be broken without a tampering attempt, these customers begin to pay less attention to the status of the closure. This in turn runs the risk of compromising the efficacy of using frangible elements, at least in the minds of the end user consumers. In other instances with the imitation closures, the frangible elements are hard to see and difficult to determine if one or more of these frangible elements are actually broken.

According to the present disclosure, there is provided a tamper-evident portion, shaped as an arcuate band, that begins in a tucked and generally concealed orientation by being deflected downwardly in between the closing cap and an outer portion of the spout, and up against an inner surface of the metal retainer. This tamper-evident band is then deployed at the time of initial opening so that a majority of the band including its upper surface are visible and this in turn provides a way to alert the end user, for example, of any tampering attempt. This tamper-evident band replaces the use of any frangible elements as the only means of determining whether or not a tampering attempt has been made. Further, there is no risk that the capping operation could ever deploy the tucked in tamper-evident band. As a result, the end user can rely on the closure status as an absolute guarantee for alerting the end user of any tampering attempt. Any attempt by an unauthorized individual to raise the bail handles of the closing cap in order to either remove the closing cap and/or extend the spout will pull the tamper-evident band (portion) out of its tucked and generally concealed initial orientation and this tamper-evident band will be visible to the end user, putting that end user on notice that some tampering attempt may have been made. This tamper-evident band, in combination with the contoured bail handles, creates a unique construction for a threaded closing cap.

Due to the tucked position of the tamper-evident band as it is initially assembled, and the importance of deploying the band, the ease of use of the bail handles takes on added importance. It is important to enhance the grasping or gripping of the handles due to the added resistance added by the tamper-evident band(s).

BRIEF SUMMARY OF THE INVENTION

A closure assembly for a container, the container including a dispensing opening, according to one embodiment of the present invention, comprises a closure body including a nestable and extendable spout, the spout defining an outlet opening, a unitary closing cap constructed and arranged for assembly to the spout for closing off the outlet opening, the closing cap including at least one movable bail handle with a raised section located between hinged ends.

One object of the present disclosure is to describe an improved container closure and closing cap.

DETAILED DESCRIPTION OF THE INVENTION

Figure 1:
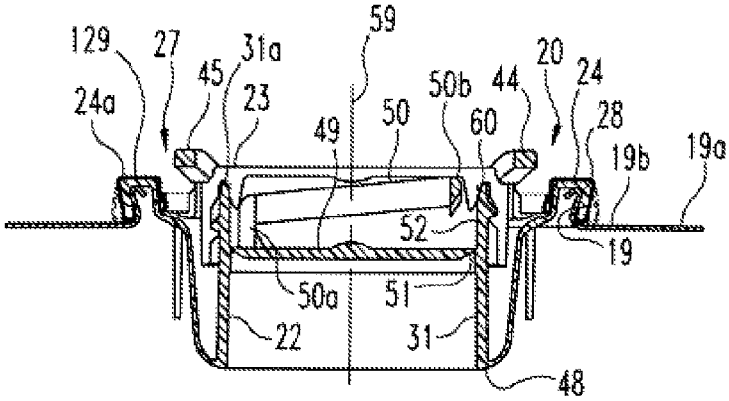
FIG. 1 is a front elevation view, in full section, of a container closure and closing cap combination according to the present invention.
Figure 2:
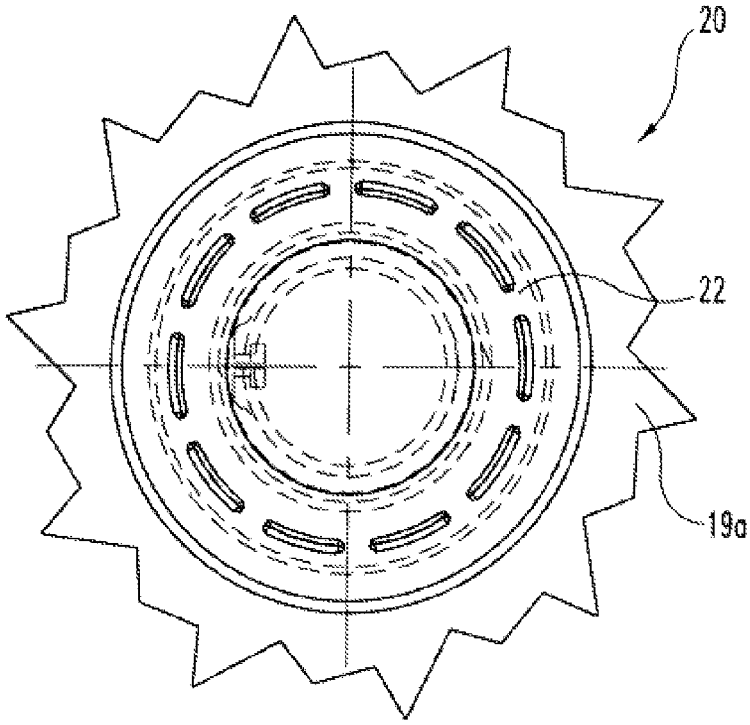
FIG. 2 is a bottom plan view of the FIG. 1 combination.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-6, there is illustrated a closure assembly 20 according to the present invention. Closure assembly 20 is constructed and arranged for secure connection to or into an outlet opening defining structure 19 whether a raised annular outlet wall or a container opening edge or some other opening configuration (see FIG. 12). The defined outlet opening is positioned within the end of a corresponding container or drum 19*a*. The upper surface 19*b* of container end 19*c* is planar and surrounds the raised annular outlet wall 19. The raised outlet wall 19 defining the outlet opening of a metal drum end is further illustrated in FIG. 3. The closure assembly 20, as described herein, can be compatibly configured for secure connection to the raised outlet wall 21 (defining the outlet opening) of a plastic drum end, see FIG. 13. However, for the FIGS. 1-6 embodiment, the raised drum end outlet wall 19 is metal, see FIG. 12.

Figure 11:
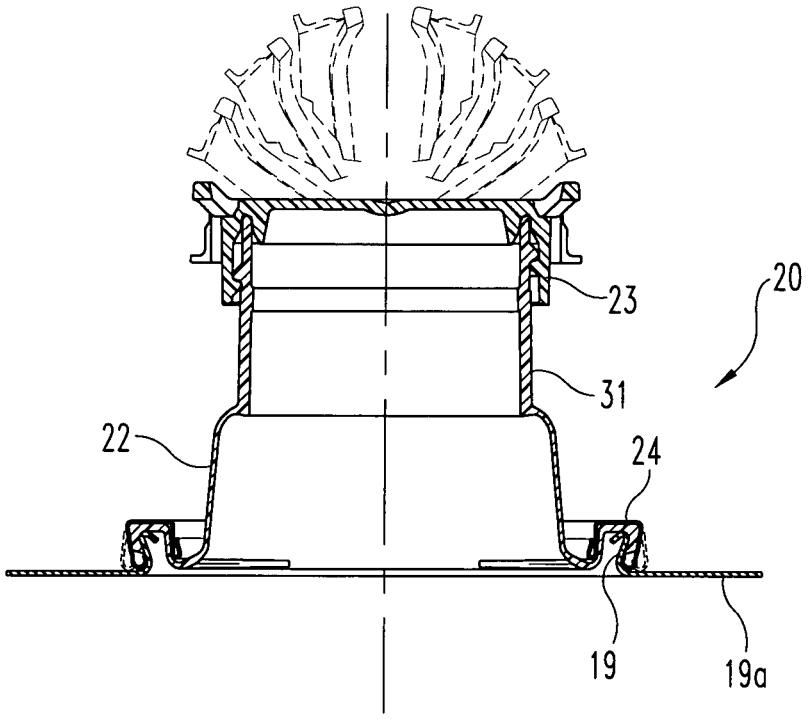
FIG. 11 is a front elevational view, in full section, of the FIG. 1 combination with the spout in an extended orientation.
Figure 14:
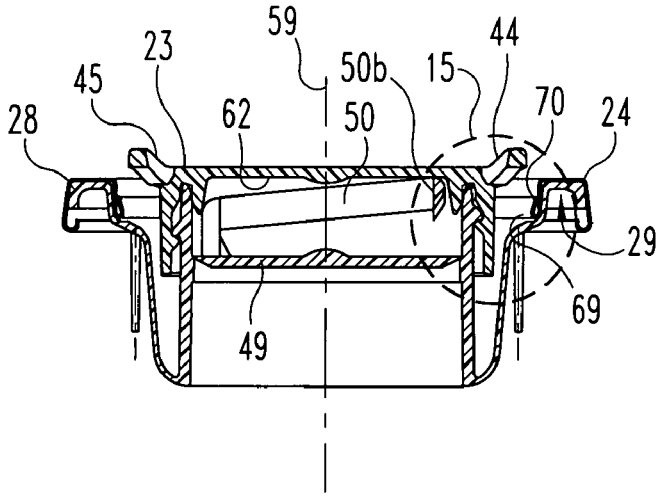
FIG. 14 is a front elevational view, in full section, of the FIG. 1 closure assembly without the FIG. 1 container.
Figure 15:
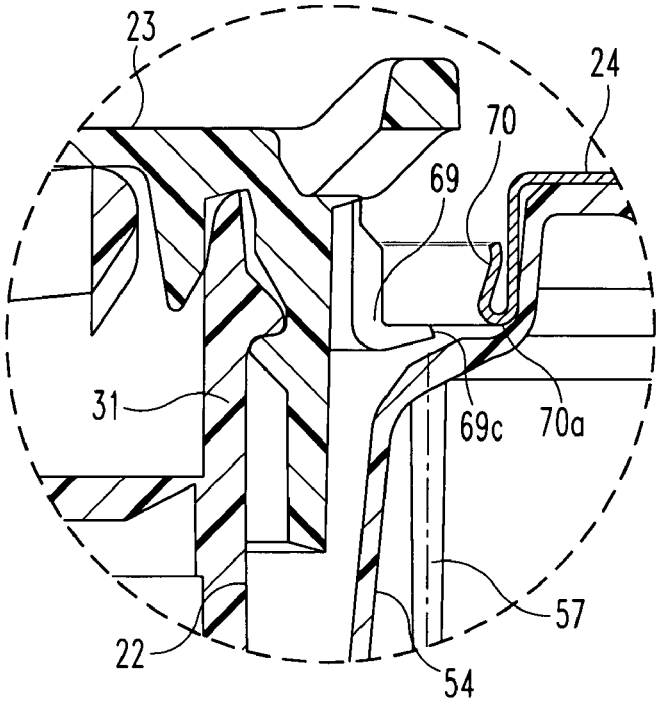
FIG. 15 is an enlarged, front elevational view, in full section, of one portion of the FIG. 14 closure assembly.
Figure 16:
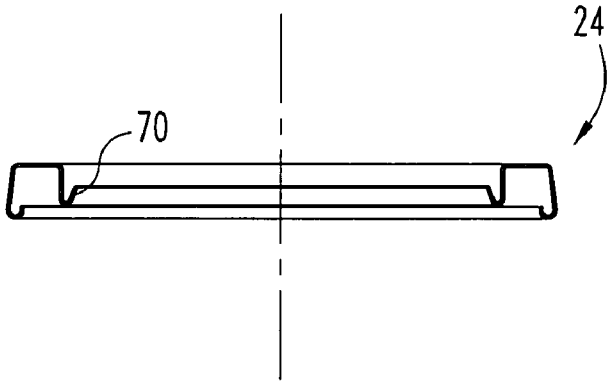
FIG. 16 is a front elevational view, in full section, of a metal retainer comprising one component part of the FIG. 1 closure assembly, according to the present invention.
Figure 17:
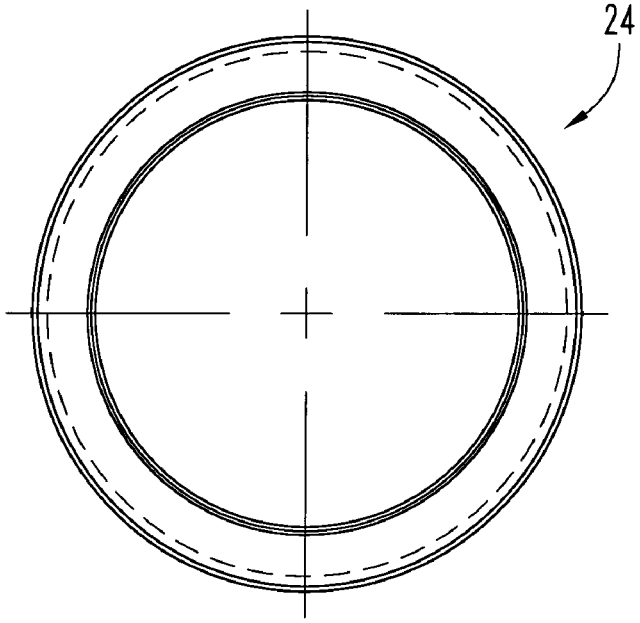
FIG. 17 is a top plan view of the entire FIG. 16 retainer.

Closure assembly 20 includes a closure body 22, tamper-evident closing cap 23, and annular metal retainer 24. Each of these three component parts constitutes a unitary component with the closure body 22 being molded out of plastic, tamper-evident closing cap 23 being molded out of plastic, and retainer 24 being formed as a unitary component out of metal. The details of the closure body 22 are illustrated in FIGS. 1-4. The details of the tamper-evident closing cap 23 are illustrated in FIGS. 5-10. The details of the metal ring retainer 24 are illustrated in FIGS. 16 and 17. Additionally, closure assembly 20 including closure body 22, closing cap 23, and retainer 24 is illustrated in FIG. 11 and in FIGS. 14 and 15, without the container end or outlet opening. While the FIG. 15 illustration provides an enlarged detail, one point to be derived from the FIG. 14 illustration is that the closure assembly can be preassembled, as illustrated, and then applied to the raised outlet wall of the container end for crimping of the retainer so as to anchor the closure body to the outlet wall.

With continued reference to FIGS. 1-6, and considering the prior remarks, it will be seen that closure assembly 20 assembles onto the formed and raised outlet wall 19 that defines outlet opening 27. The closure body 22 includes an annular outlet lip 28 formed with an inverted annular channel 29. The annular channel 29 fits over and around outlet wall 19, see FIG. 1. Once the closure body 22 and outlet wall 19 are assembled in this manner, noting that the annular metal retainer 24 is preassembled to the closure body, this positions the metal retainer 24 over and around the outer lip 28. The next step is to crimp the metal retainer 24 so as to securely and tightly clamp the outer lip 28 onto and around the outlet wall 19, creating a sealed interface and a secure annular connection.

The tamper-evident closing cap 23 is internally threaded and the dispensing end 30 of the nestable and extendable spout 31 of closure body 22 is externally threaded for receipt of the closing cap 23. The closing cap 23 can be threaded onto spout 31 either before or after the closure body is crimped onto outlet wall 19 by the use of metal retainer 24. However, in terms of an initial subassembly of closure assembly 20 with its three component parts, the metal retainer 24 would be preassembled onto the closure body.

Figure 12:
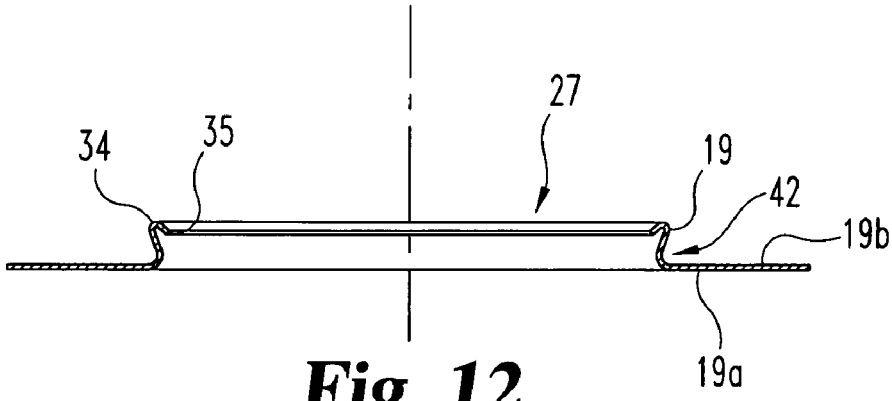
FIG. 12 is a front elevational view, in full section, of a raised container outlet wall defining an outlet opening of a metal container.
Figure 13:
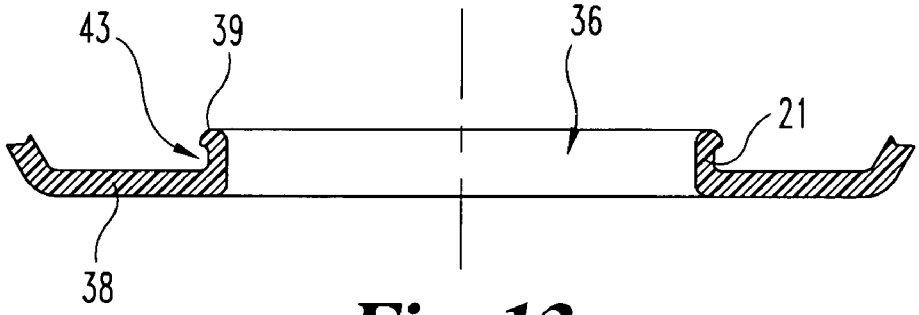
FIG. 13 is a front elevational view, in full section, of a raised container outlet wall defining an outlet opening of a plastic container.

Referring to FIGS. 12 and 13, the raised outlet wall 19 that defines outlet opening 27 includes a curved upper edge 34 and a depending inner lip 35. The annular channel 29 of the closure has a compatible interior geometry relative to the curvature of edge 34 and this facilitates the crimping operation using the metal retainer 24. In FIG. 13, the outlet opening 36 is defined by raised outlet wall 21. The unitary plastic construction of the outlet wall 21 and drum (or container) end 38 provides the curved upper edge 39 by means of its molding process. When a plastic drum is being used, one alternative design is to modify the tamper-evident cap with an outer annular portion that snaps over the combination of the closure body and outlet wall. This outer annular portion of the cap replaces the metal retainer 24.

With continued reference to FIGS. 12 and 13, the outlet wall 19 is formed with an undercut or relief 42 below the curved upper edge. A similar relief 43 is molded into outlet wall 21. These reliefs 42 and 43 provide a clearance space for the movement of material of the annular channel 29 as the crimping operation applied to the metal retainer 24 takes place. These reliefs 42 and 43 also help to prevent any chance of pulling the closure body 22 off of the raised outlet wall 19 as the closure body spout 31 is extended from its nested orientation by pulling upwardly in an axial direction the bail handles 44 and 45 of the closing cap 23.

Figure 3:
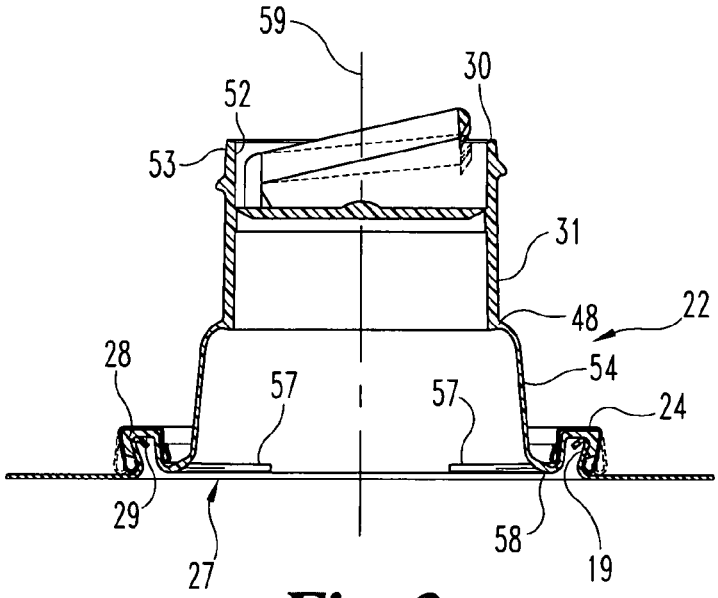
FIG. 3 is a front elevational view of the FIG. 1 container closure with the closing cap removed and the closure spout extended.
Figure 4:
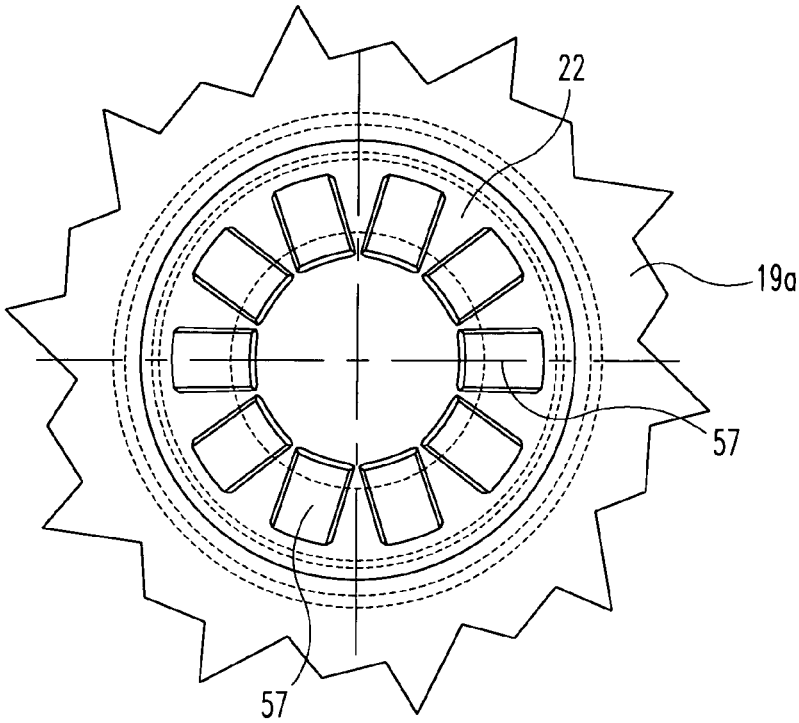
FIG. 4 is a bottom plan view of the FIG. 3 container closure.
Figure 5:
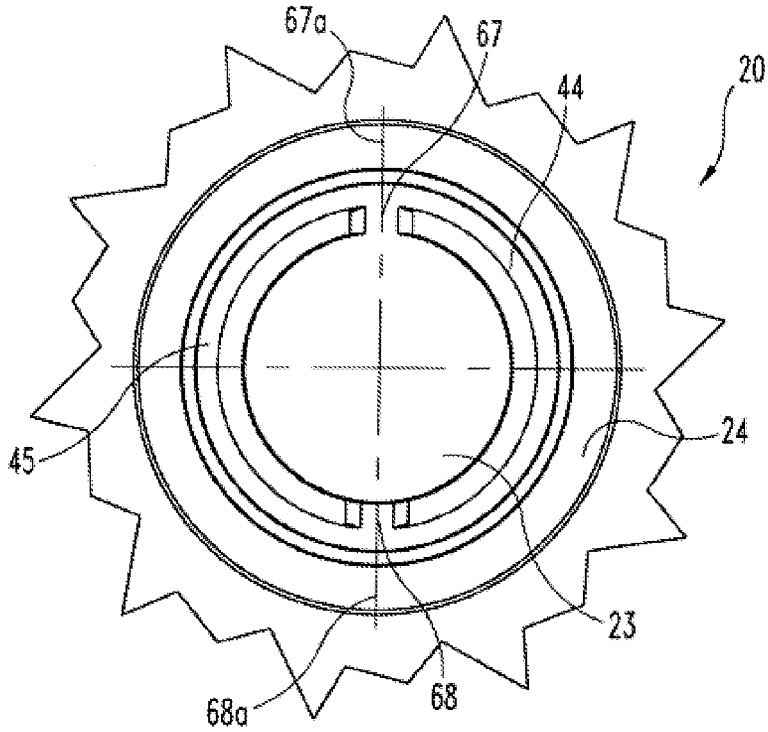
FIG. 5 is a top plan view of the FIG. 1 closing cap, as assembled.

With continued reference to FIGS. 1-6, closure body 22 includes an invertible fold 48 that reverses its orientation when changing the closure body from a nested orientation (see FIG. 1) to an extended orientation (see FIG. 3). Closure body 22 also includes a tear-out diaphragm 49 with a unitary pull ring 50. A weakened annular score line 51 or an annular severable membrane surrounds the diaphragm 49 and connects the outer edge of the diaphragm to the inner surface 52 of the spout 31. The pull ring 50 is joined to one edge portion of diaphragm 49 and by pulling upwardly on ring 50, the diaphragm 49 is able to be torn out of the interior of spout 31. This tearing out is accomplished by causing the annular score line (or membrane) to sever. As an alternative to the use of pull ring 50, this diaphragm could be cut free from its unitary connection with spout 31. However, the use of pull ring 50 is believed to be preferred and, due to the weakened score line or membrane, continued pulling on ring 50 causes the entire diaphragm 49 to separate from within spout 31. The unitary molding of closure body 22 includes the unitary construction of pull ring 50 and diaphragm 49. This molding of a suitable plastic material is performed in a manner that positions the connecting post 50*a* of the pull ring 50 with a generally vertical orientation. The mold design also orients the pull ring 50 with a slight incline. Based in part on where the diaphragm 49 is placed axially within spout 31 and based in part on the angle of incline of pull ring 50 and based in part on the height of post 50*a*, the free end 50*b* of pull ring 50 extends above the upper edge 31*a* of spout 31. When the tamper-evident cap 23 (see FIGS. 6-10) is threaded onto the spout 31, the upper edge 31*a* pushes into annular channel 60 with a snug fit. The thickness of the cylindrical section 53 relative to the radial width of channel 60 causes flexible wall 61 to flex and apply pressure to the inner surface 52 of spout 31 (see FIG. 1).

The spout 31 can be considered as having two sections, an inner, generally cylindrical, section 53 and an outer, frustoconical, section 54. These two sections are separated by the invertible fold 48. The outer section 54 includes a series of venting ears 57 that are positioned at fold 58 and depend in an axially downward direction when the closure body 22 is in its nested orientation. When the closure body 22, specifically the spout 31, is extended, the fold 58 moves and flips the venting ears 57 into a lateral orientation, see FIGS. 3 and 4. In terms of the directions referenced herein, FIG. 1 represents the typical, upright orientation and centerline 59 represents the longitudinal axis through the geometric center of the closure assembly 20. As used herein, an axial direction is parallel to centerline 59 and a lateral direction is perpendicular to centerline 59.

When the tamper-evident closing cap 23 is fully threaded onto spout 31 (see FIG. 14), the inner surface 62 pushes down on the free end 50*b* of the pull ring 50. However, due to the elastic properties of the plastic used for the closure body 22, once the tamper-evident closing cap 23 is removed, the pull ring 50 flexes (pivots) upwardly so that the free end 50*b* is returned to its free state, slightly above the upper edge 31*a* of spout 31, as illustrated in FIG. 3. The illustrated free state of pull ring 50 orients the free end 50*b* slightly above upper edge 31*a*. By positioning the diaphragm 49 at its illustrated location and by the construction and arrangement of the pull ring 50, the pull ring is more accessible and easier to grasp when compared to earlier designs that recess the diaphragm and pull ring farther down (axially) into the spout.

Referring more specifically to FIGS. 5-10 and with continued reference to FIGS. 1-4, closing cap 23 is illustrated in detail. Closing cap 23 includes a body having a sidewall 23*a* and a top panel 23*b*. Closing cap 23 further includes, as part of its unitary, molded plastic construction, a pair of oppositely-disposed bail handles 44 and 45. Each bail handle 44 and 45 is joined to the remainder of the closing cap 23, specifically to the top panel 23*b*, by living hinges 67 and 68, respectively. As is illustrated, each bail handle 44 and 45 is symmetrically constructed relative to the other bail handle. Each bail handle 44 and 45 effectively begins at one end at the centerline of hinge 67 and extends to its opposite end that coincides with the centerline of hinge 68. Both bail handles 44 and 45 are commonly joined (unitarily molded) to hinge 67 and to hinge 68.

As initially configured, prior to any opening of the closure assembly, the bail handles 44 and 45 lay in a down or closed condition, generally adjacent the inner, upper edge of retainer 24. Each bail handle is molded and shaped with a contoured section 44*a* and 45*a*, respectively. A portion of each center section 44*a* and 45*a* axially extends above said top panel 23*b*. These contoured sections are an important design aspect that will be described in greater detail hereinafter, including a variety of functionally equivalent design alternatives.

Surrounding the bail handles 44 and 45 and unitarily joined therewith as part of the molded plastic construction of cap 23 is an arcuate, flexible "warning" flap 69. Flap 69 is constructed and arranged for a message to be screened, embossed, or otherwise marked in some fashion, depending on the intended use and circumstances relating to closure assembly 20. Since it may be possible to provide a suitable closure assembly with only one bail handle, the flexible "warning" flap is described as being arcuate in form. It is though contemplated by the present invention that, with the use of two contoured bail handles 44 and 45, as illustrated, there are preferably two arcuate flaps (sections) 69. One flap 69 extends around a portion of each bail handle, generally centered on hinge 67. The other flap 69 is similarly arranged relative to hinge 68. Neither flap 69 extends below the center contoured section of each bail handle so as to leave maximum clearance for the user to insert a finger (or thumb) tip. Each flap 69 includes a free edge 69*a*, 69*b* that is angled outwardly at a 30 degree angle relative to the axial (vertical) centerline. Flap 69 that is centered on hinge 68 includes opposite free edges 69*a*. Flap 69 that is centered on hinge 67 includes opposite free edges 69*b*. The notch below each contoured section 44*a* and 44*b* is defined by one free edge 69*a* and one free edge 69*b*. This 30 degree angle creates a circumferentially wider notch area adjacent the lower edge of each flap 69, tapering inwardly as the notch approaches the bail handle 44 or 45.

Flap 69, whether as an annular form or as an arcuate section, or as two arcuate sections, is initially deflected and tucked down into the space between the bail handles and the metal retainer 24, up against the annular inner wall 70 of the metal retainer 24, as illustrated in FIGS. 14 and 15. The outer radial lip 69*c* of each flap 69 is positioned (tucked) beneath the bend 70*a* at the lower end of inner wall 70. Further reference herein to "flap 69" is intended to refer to and encompass both flaps 69. In this deflected, tucked, and inserted condition, whatever writing or marking or embossment may be displayed on the upper surface of flap 69, that information will not be visible and, for the most part, flap 69 is not visible except for a small portion that is shown as connecting (unitarily) to the corresponding bail handle. However, when the bail handles 44 and 45 are lifted, see FIGS. 11 and 18, the flap 69 deploys and not only the flap, but the upper surface of the flap becomes visible. This means that the end user can read whatever message, information, or warning has been placed on the upper surface of the flap and it is intended that this upper surface would be used for a warning and as an alert to advise the end user that a tampering attempt may have occurred if the flap 69 is deployed. This is why the flap 69 is described as being a tamper-evident, deployable flap.

While the deployment of flap 69, even without any markings, writings, or message, would still indicate an attempt to tamper with the container contents, or at least an attempt to open the closure assembly, the addition of some type of warning or alert message directly onto the flap provides an added reminder to the end user and helps to reinforce the understanding that, if the flap 69 is out of its tucked or inserted condition, the end user should be aware that someone, at some time "upstream", lifted the bail handles and the only reason to do so would be an attempt to open the closure assembly. The use of flap 69 provides a different style of tamper evidencing and thus the reason to select the term "warning" in describing the construction and use of flap 69. The intended message is some type of statement or explanation that if flap 69 is deployed, be careful when dispensing and using the contents of the container.

When the bail handles 44 and 45 are secured by some type of frangible element connection, that style of connection could serve as another indicator of a tampering attempt. However, that tamper-evident technique would typically not be as visible and not as pronounced as the use of flap 69. Further, some of the products that are currently on the market as an imitation of the Rieke FLEXSPOUT® product may include broken frangible elements due to the manner of construction and design and the presence of broken frangible elements when there has not been any tampering attempt tends to desensitize the end user to the significance of the frangible elements. Preferably frangible elements are not used for either of the bail handles 44 and 45.

The tear-out diaphragm 49 can also serve as another indicator of a tampering attempt if the end user knows and can always remember that the tear-out diaphragm 49 should be present on the interior of spout 31 and should be completely secured to the spout around its entire inside diameter. Even with these alternatives for tamper indicating measures, the use of warning flap 69 is believed to be preferred in that the only way to actually defeat flap 69 is to cut it off completely and with a near perfect, completely smooth edge. That becomes a very difficult, if not virtually impossible task, considering the size, shape, and material of flap 69 and the time and tools available to the individual considering a tampering attempt. Even if the end user may not know or recall that a warning flap should be present, a jagged cut edge will certainly put that end user on notice that something is wrong, or at least may be wrong.

In use, whether or not the bail handles 44 and 45 are each secured in a down (closed) orientation by a frangible element, the living hinge and the initially molded condition positions the bail handles down and adjacent the inner, upper edge of retainer 24. The orientation of the two bail handles positions them adjacent to and slightly above the upper surface 24*a* of metal retainer (ring) 24. The raised center section 44*a*, 45*a* is axially higher than the hinged sections. However, when the bail handles are lifted as the only effective way to either remove the closing cap 23 and/or extend spout 31, the living hinges 67 and 68 experience a slight plastic deformation. This causes the bail handles 44 and 45 to remain slightly raised, see FIG. 18, even after releasing the lifting bail handles and threading the closing cap 23 back onto spout 31 and/or after nesting spout 31. If there was an attempt to try and refold or reinsert flap 69 back into its initial FIG. 1 or FIG. 15 condition, the set or deformation experienced by the living hinges for bail handles 44 and 45 still returns those bail handles to the raised FIG. 18 orientation and this pulls the flap 69 out of its tucked or inserted condition, thereby continuing to expose the flap and the upper surface of flap 69 including any message or writing thereon. Even if the design of the bail handles and the living hinges, and considering the selection of plastic, would enable the bail handles to return to a planar condition, it would still not be possible to re-tuck the deployable flap(s). The thought here is that the circular form of the flap or the arcuate forms of the flap sections, considering the elasticity of plastic, would prevent someone from re-folding and re-tucking the flap or flaps back into their starting orientation.

Figure 19:
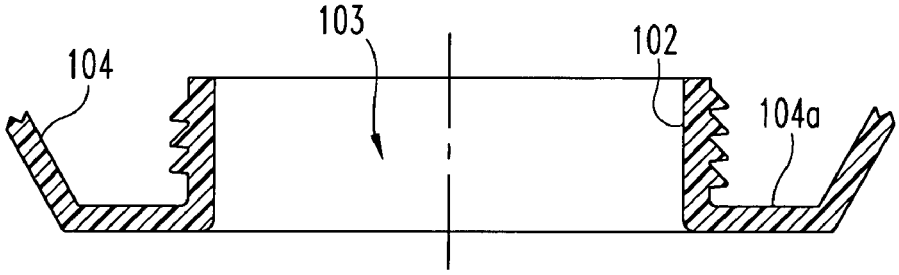
FIG. 19 is a partial, front elevational view, in full section, of a plastic container opening for receipt of a closure assembly according to the present invention.
Figure 20:
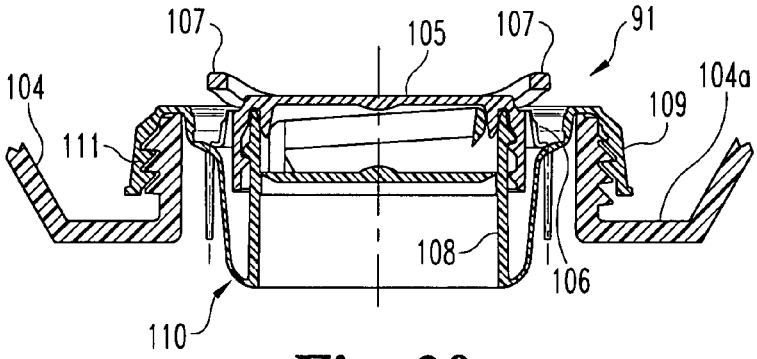
FIG. 20 is a front elevational view, in full section, of a container closure and closing cap combination, according to the present invention, as assembled onto the FIG. 19 container, by threaded engagement.
Figure 21:
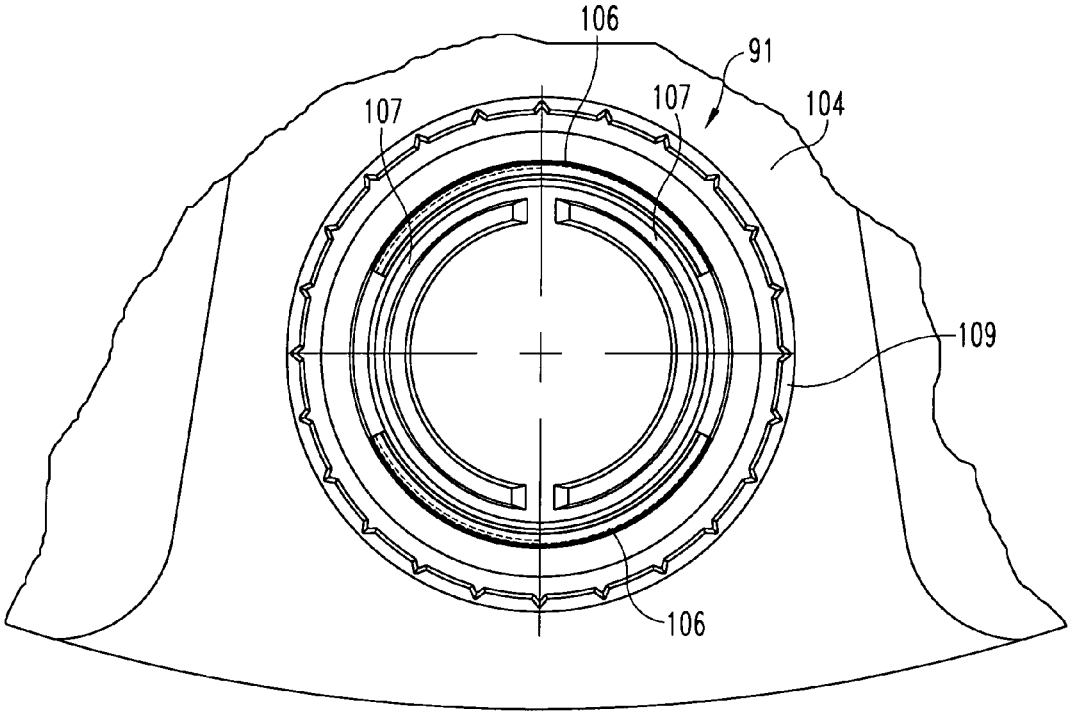
FIG. 21 is a top plan view of the FIG. 20 combination.

Referring now to FIGS. 19, 20, and 21, closure assembly 91 is constructed and arranged to thread onto a raised (plastic), externally-threaded outlet wall 102 that defines dispensing opening 103. The container end 104 is formed with a recessed panel 104*a* so that the closure assembly 91, once applied, will be substantially flush with the outer surface of the container end 104.

Closure assembly 91 is virtually identical to closure assembly 20 except for the elimination of metal retainer 24 and changing the shape and configuration of the outer lip 28. Otherwise, the closing cap 105 is identical to closing cap 23, including all structural features, materials, dimensions and relationships for the cap body, the bail handles, and flap. Flap 106 is identical to flap 69 and is initially folded and tucked into position in substantially the same way as flap 69. Flap 106 also deploys in the same way as flap 69 when the bail handle or handles 107 are lifted as part of the process to extend the spout 108 from its nested orientation.

The annular outer lip 109 of closure body 110 is configured with an internally-threaded, depending annular wall 111. The threaded wall 111 is constructed and arranged to tightly and securely thread onto outlet wall 102 (see FIG. 20).

With continued reference to FIGS. 1 and 5-10, and as already described, closing cap 23 includes hinged bail handles 44 and 45. Each bail handle is molded with a contoured center section 44*a* and 45*a*, respectively. Since bail handles 44 and 45 are essentially identical in form, fit, and function, including their contoured center sections 44*a* and 45*a*, the specifics are described in the context of bail handle 44.

Each bail handle has a generally part-circular or part-cylindrical arcuate form extending between living hinges 67 and 68. The living hinges 67 and 68 are diametrically opposite such that their centerlines, 67*a* and 68*a*, respectively, are coincident with the diameter line through the axis of closing cap 23.

Considering the generally semicircular or semi-cylindrical shape of bail handle 44, and the same for bail handle 45, it will be appreciated that bail handle 44 includes a first end section 120, an opposite end section 121, and a contoured center section 44*a* that is symmetrically centered between sections 120 and 121. In terms of circumferential extent or measurement, beginning at hinge centerline 67*a* to the start of section 44*a*, this circumferential arc distance is approximately one-third (⅓) of the distance from hinge centerline 67*a* to hinge centerline 68*a* and thus the included angle measures approximately sixty degrees (60°) which is approximately one-third of the 180 degree circumferential measurement between the two hinge centerlines. The symmetrical positioning of section 44*a* means that the circumferential distance from the end of section 44*a* to hinge 68 centerline 68*a* measures approximately sixty degrees (60°). This in turn means that the center section 44*a* accounts for the remaining one-third of that 180 degree circumferential measurement. The flaps 69 do not extend below the center section of either bail handle.

The curved or rounded shape of center section 44*a* creates a concave clearance space 122 that is defined by the curved undersurface 123 of center section 44*a*. Broken line 124 is co-planar with the undersurface of sections 120 and 121 and line 124 essentially defines the lower edge of space 122. This clearance space 122, combined with the raised, curved center section 44*a* provides a convenient structure for a finger or thumb tip of the user to be inserted for initiating the lifting of the corresponding bail handle 44 (or 45).

Figure 18:
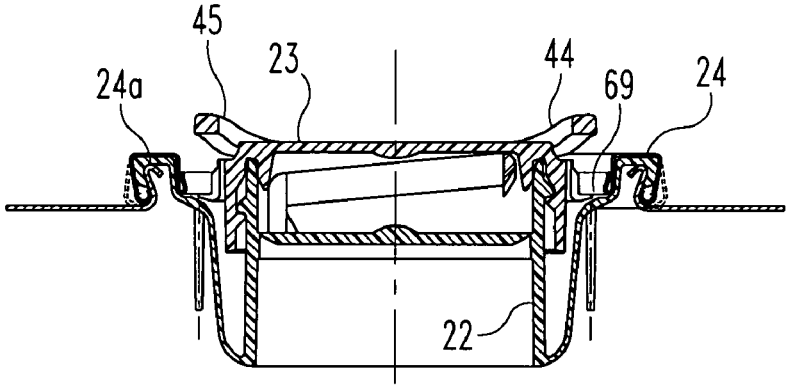
FIG. 18 is a front elevational view, in full section, of the FIG. 1 closure assembly after the bail handles have been released from the lifted orientation.

As explained, for the manipulation of the spout for dispensing, the bail handles 44 and 45 are first lifted (pivoted) from their folded or closed condition, see FIG. 1, to a raised position starting as in FIG. 18 and ending as in FIG. 11. With the closing cap 23 fully threaded onto the nested spout, the raised (lifted) bail handles provide a structure that is suitable to be used for pulling upwardly on the spout, moving it from a nested orientation to an extended orientation. The bail handles are also suitable to be used as a convenient way of unscrewing the closing cap 23 from the dispensing spout.

Figure 6:
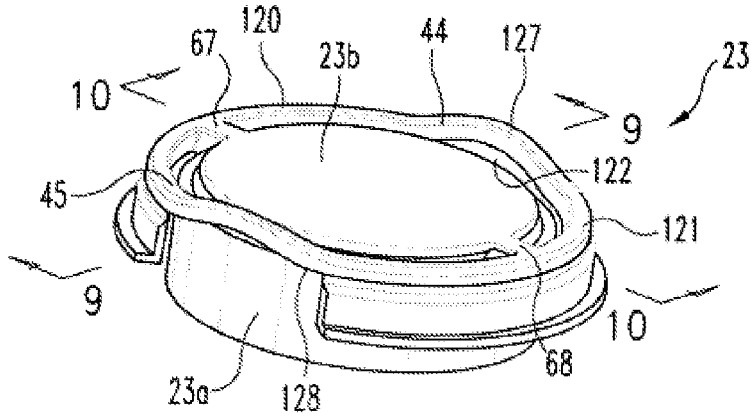
FIG. 6 is a perspective view of the FIG. 5 closing cap, as unassembled.
Figure 7:
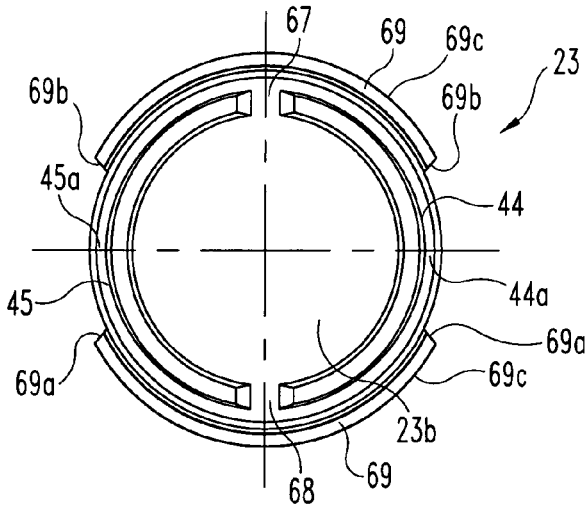
FIG. 7 is a top plan view of the FIG. 6 closing cap.
Figure 8:
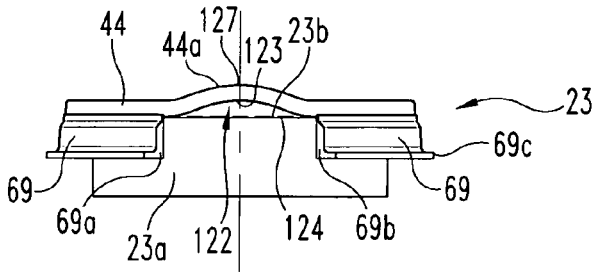
FIG. 8 is a front elevational view of the FIG. 6 closing cap.
Figure 9:
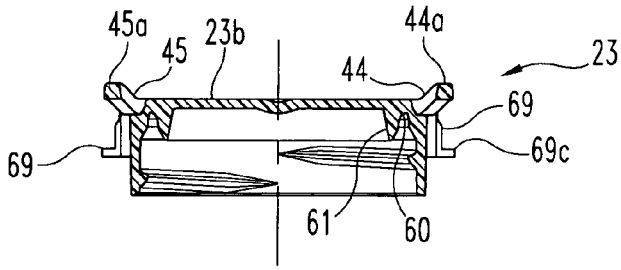
FIG. 9 is a front elevational view, in full section, of the FIG. 6 closing cap, as viewed along line 9-9 in FIG. 6.
Figure 10:
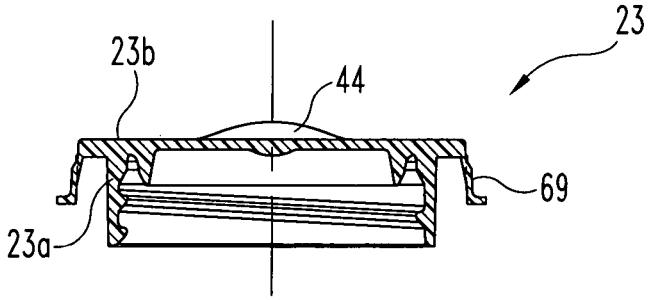
FIG. 10 is a front elevational view, in full section, of the FIG. 6 closing cap, as viewed along line 10-10 in FIG. 6.

Another structural form or feature of each bail handle 44 and 45 in terms of its size, shape, and contour, and its positioning and relationship with the remainder of the closure assembly including metal ring retainer 24, is the angle of incline of the uppermost portion 127 of center section 44*a*. Referring to FIGS. 1, 6 and 9, the raised and angled (inclined) configuration of each center section 44*a* is fully illustrated. The raised and angled bail handle configuration, in cooperation with the clearance space 122, helps in facilitating the lifting of each bail handle 44 and 45. It is intended for the undersurface 128 of each end section 120 and 121 to be positioned so as to be anywhere from between co-planar to raised above the upper surface 129 of ring retainer 24. This allows both visibility and access to the underside surface 123 of center section 44*a*.

Referring now to FIGS. 22-39, variations in the construction and arrangement of other contoured or shaped bail handles for a closing cap for a closure are illustrated. The focus is on creating a raised portion as part of each bail handle that is shaped and oriented so as to provide a clearance space beneath the raised portion for a finger tip or thumb tip to be inserted.

As illustrated in FIGS. 22-39, some of the possible variations and design options for shaped or contoured bail handles include differently shaped center section designs and center sections that have a greater axial height. Another possible design variation is to form the shaped section with a different inclined angle. Yet another possible design variation, although not illustrated, is to locate the "center" section off-center or in a non-symmetrical location, i.e., closer to one hinge point than the other hinge point. Further design variations for the bail handles include the size in lateral section of the bail handle or, at a minimum, of the shaped section of the bail handle.

Figure 22:
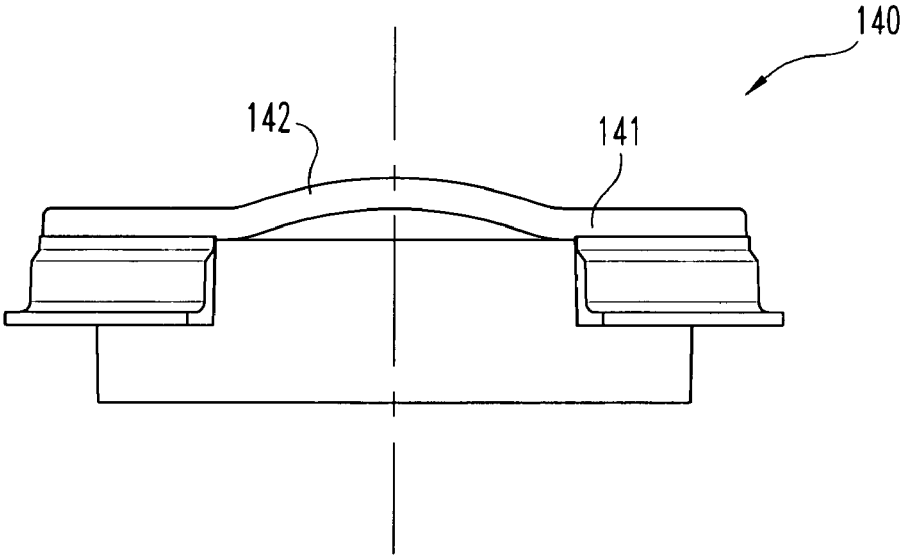
FIG. 22 is a front elevational view of an alternative closing cap according to the present invention.
Figure 23:
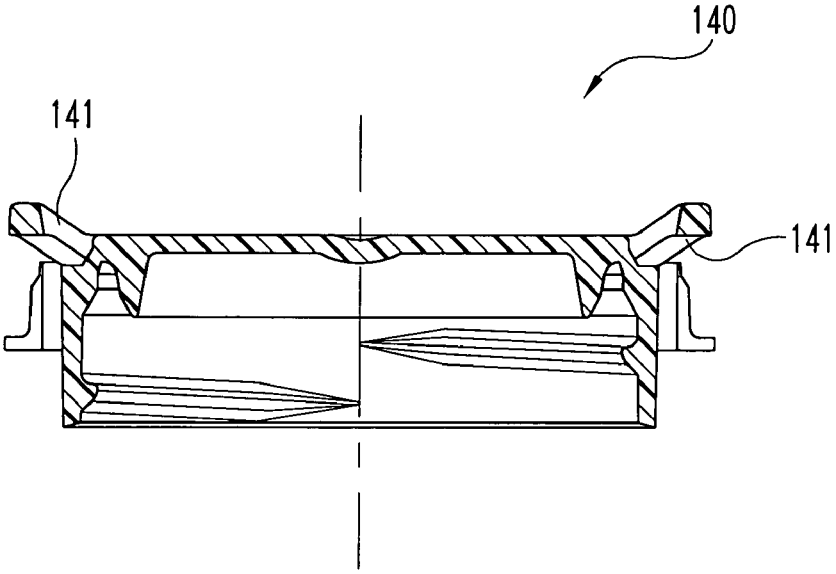
FIG. 23 is a front elevational view, in full section, of the FIG. 22 closing cap as viewed in a plane 90 degrees to the FIG. 22 orientation.

FIGS. 22 and 23 illustrate a unitary, molded plastic closing cap 140 constructed and arranged with a pair of hinged bail handles 141. Except for the specific size, shape, and contours of the bail handles 141, closing cap 140 is constructed and arranged the same as closing cap 23. More specifically, each bail handle 141 is shaped with a more elongated curved center section 142 in terms of its circumferential arc length relative to the overall length between the two opposing hinge points.

Figure 24:
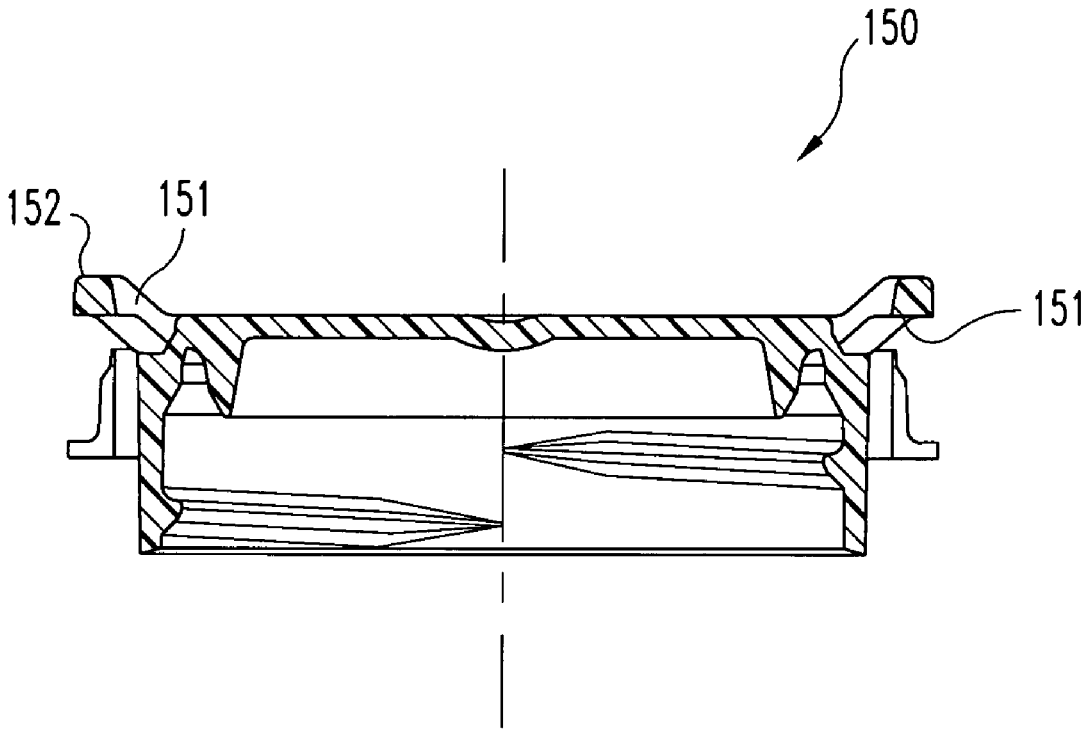
FIG. 24 is a front elevational view, in full section, of another alternative closing cap according to the present invention.

Referring now to FIG. 24, a first variation to closing cap 140 is provided by closing cap 150. The bail handles 151 of closing cap 150 are identical to bail handles 141 of closing cap 140, except that the upwardly and outwardly inclined shape of the center section 152 is more upright than with center section 142.

Figure 25:
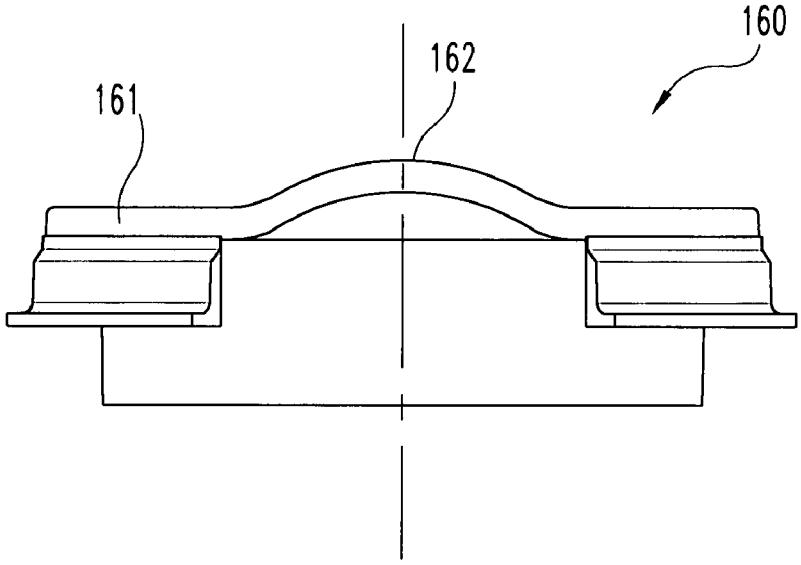
FIG. 25 is a front elevational view of another alternative closing cap according to the present invention.
Figure 26:
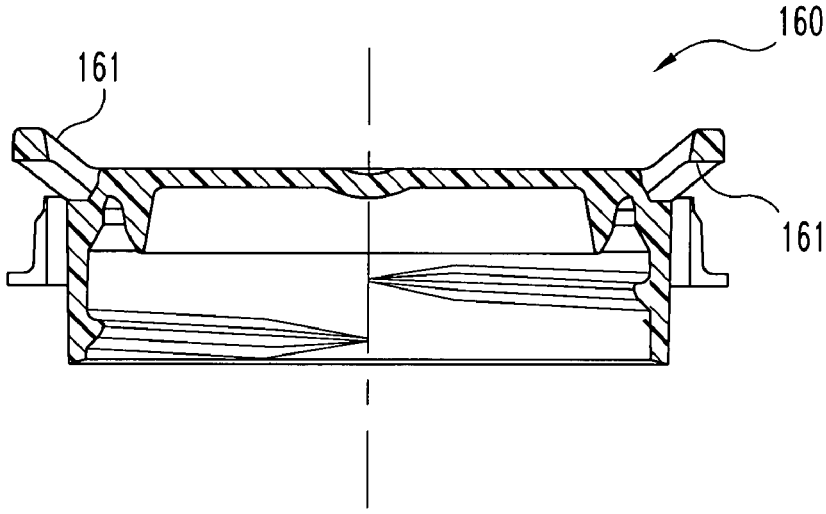
FIG. 26 is a front elevational view, in full section, of the FIG. 25 closing cap as viewed in a plane 90 degrees to the FIG. 25 orientation.

Referring to now to FIGS. 25 and 26, a second variation to closing cap 140 is provided by closing cap 160. The bail handles 161 of closing cap 160 are identical to bail handles 141 of closing cap 140, except that the overall axial height of curved center section 162 relative to the upper surface of the closing cap 160 is higher than that of center section 142 relative to the upper surface of closing cap 140.

Figure 27:
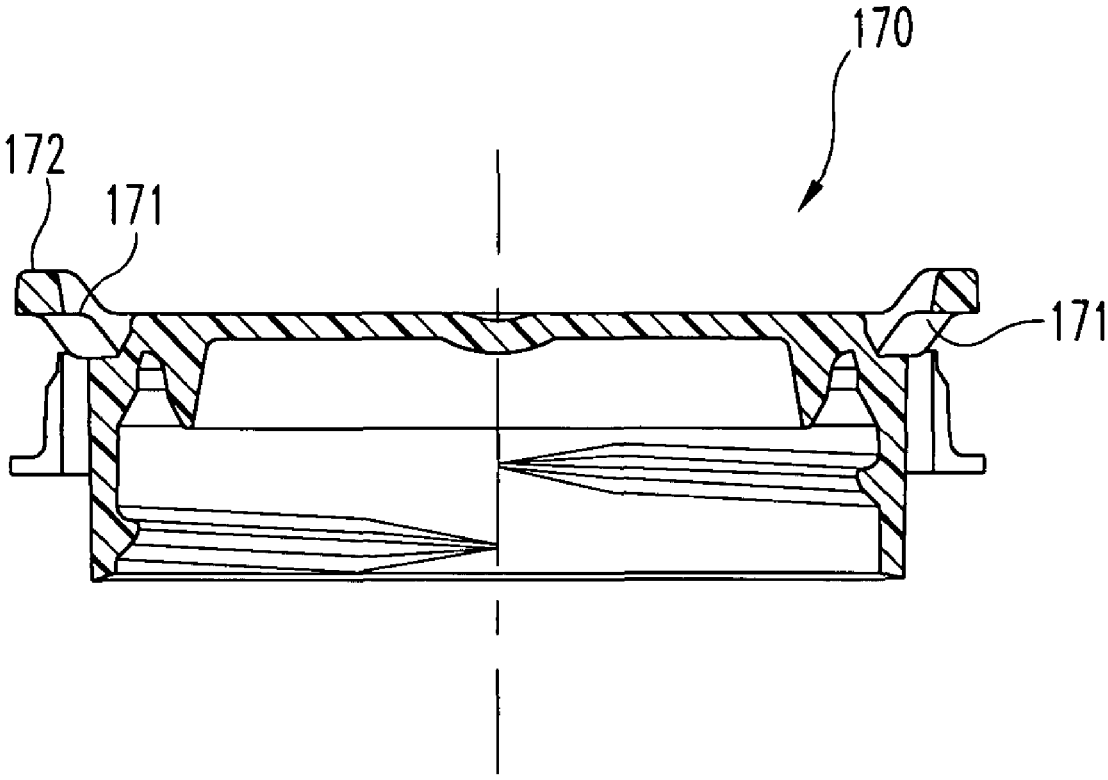
FIG. 27 is a front elevational view, in full section, of another alternative closing cap according to the present invention.

Referring to FIG. 27, a third variation to closing cap 140 is provided by closing cap 170. The bail handles 171, including center section 172, incorporate both of the two prior design modifications. These include the design modification provided as part of bail handles 151 (more upright inclined angle) and that provided as part of bail handles 161 (increased axial height).

Figure 28:
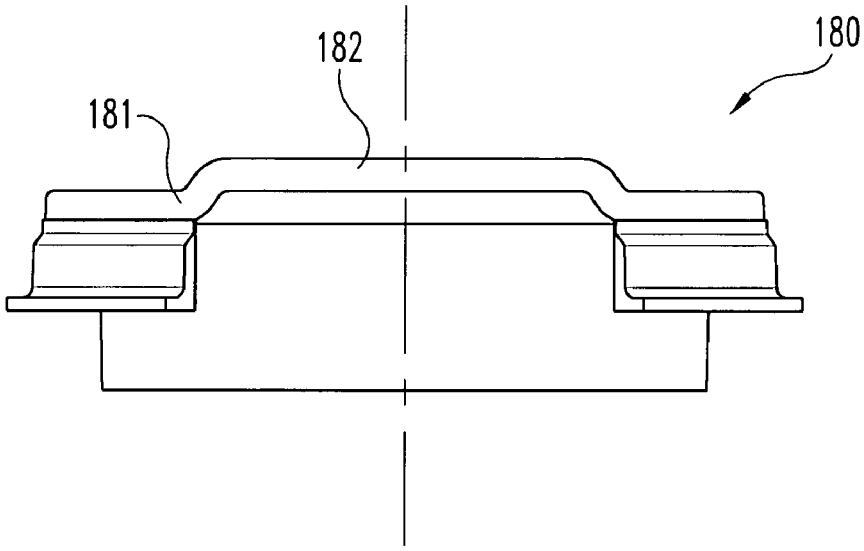
FIG. 28 is a front elevational view of another alternative closing cap according to the present invention.
Figure 29:
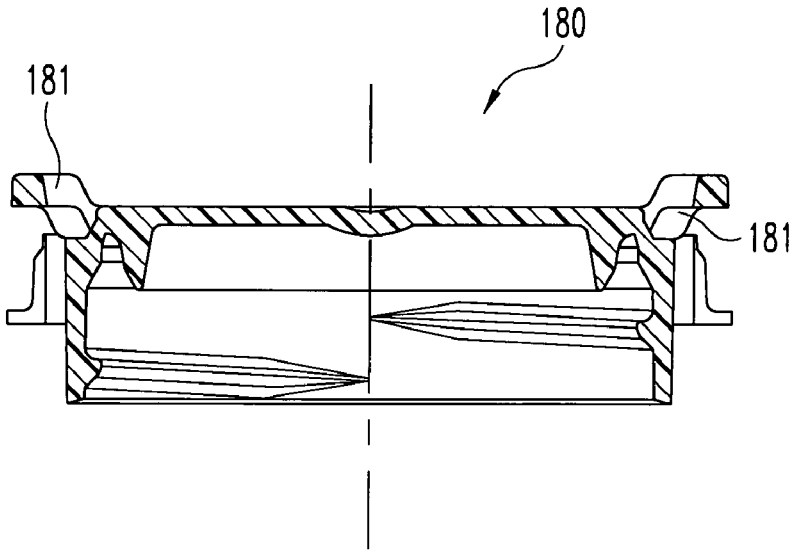
FIG. 29 is a front elevational view, in full section, of the FIG. 28 closing cap as viewed in a plane 90 degrees to the FIG. 28 orientation.

FIGS. 28 and 29 illustrate a unitary, molded plastic closing cap 180 constructed and arranged with a pair of hinged bail handles 181. Except for the specific size, shape, and contours of the bail handles 181, closing cap 180 is constructed and arranged the same as closing cap 23. More specifically, each bail handle 181 is shaped with a more elongated center section 182 and that center section is more rectangular than convex. In other words, the curved upper surface seen as part of the original disclosure for closing cap 23 and for closing cap 140 is replaced with a substantially flat and straight upper surface and sides that are more flat and straight than curved. The sides have the appearance of ramp sections that are straight and inclined upwardly and inwardly.

Figure 30:
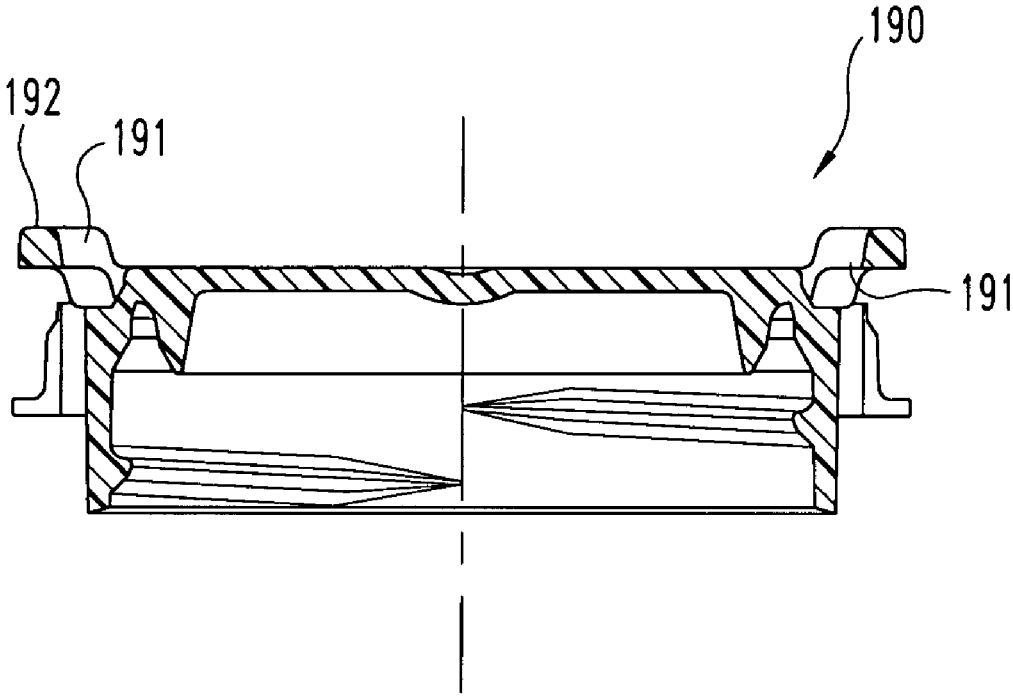
FIG. 30 is a front elevational view, in full section, of another alternative closing cap according to the present invention.

Referring now to FIG. 30, a first variation to closing cap 180 is provided by closing cap 190. The bail handles 191 of closing cap 190 are identical to bail handles 181 of closing cap 180, except that the upwardly and outwardly inclined shape of the center section 192 is more upright than with center section 182.

Figure 31:
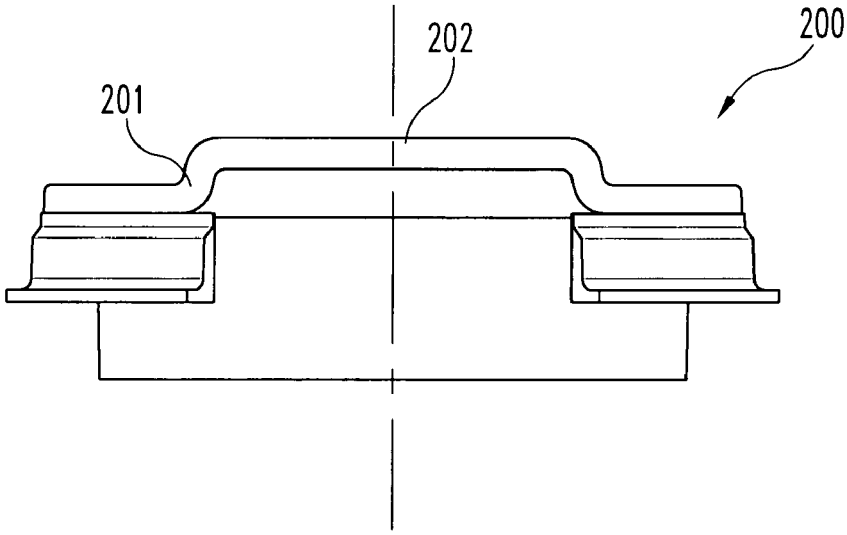
FIG. 31 is a front elevational view, in full section, of another alternative closing cap according to the present invention.
Figure 32:
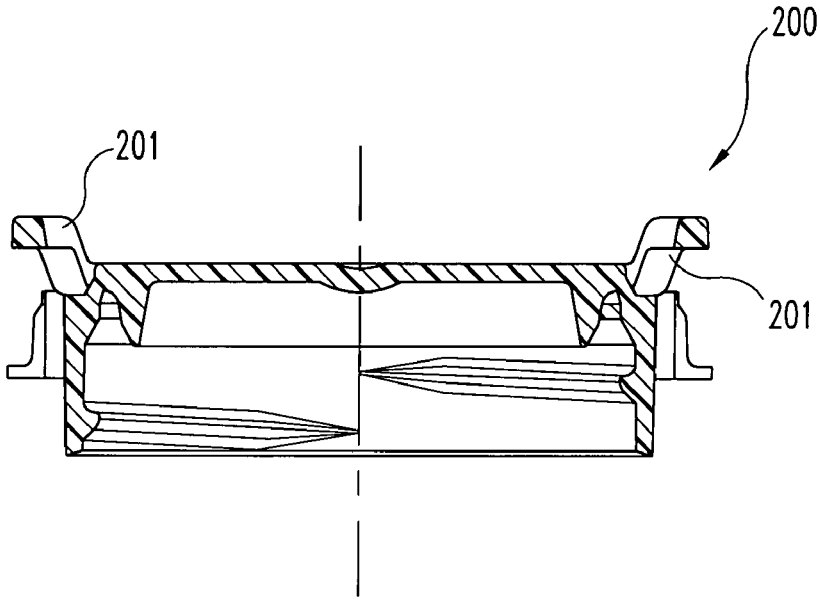
FIG. 32 is a front elevational view of the FIG. 31 closing cap as viewed in a plane 90 degrees to the FIG. 31 orientation.

Referring to now to FIGS. 31 and 32, a second variation to closing cap 180 is provided by closing cap 200. The bail handles 201 of closing cap 200 are identical to bail handles 181 of closing cap 180, except that the overall axial height of center section 202 relative to the upper surface of the closing cap 200 is higher than that of center section 182 relative to the upper surface of closing cap 180.

Figure 33:
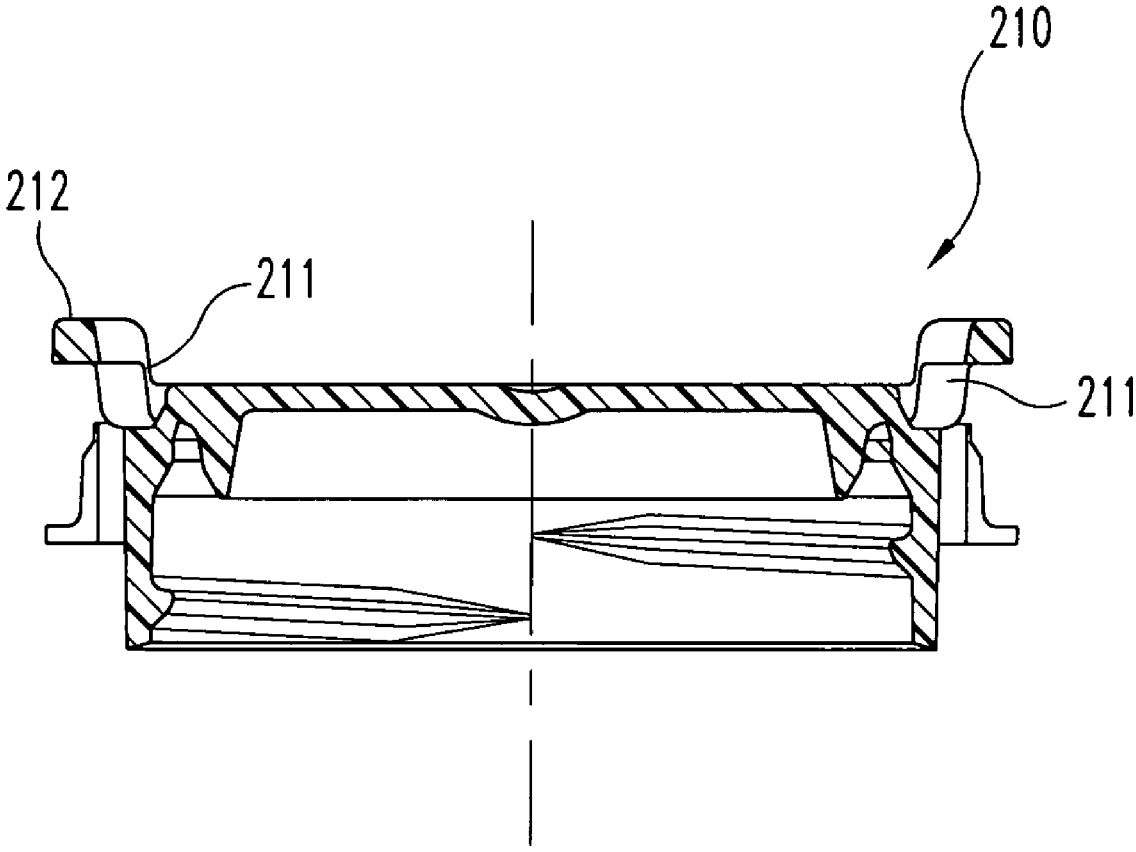
FIG. 33 is a front elevational view, in full section, of another alternative closing cap according to the present invention.

Referring to FIG. 33, a third variation to closing cap 180 is provided by closing cap 210. The bail handles 211, including center section 212, incorporate both of the two prior design modifications. These include the design modification provided as part of bail handles 191 (more upright inclined angle) and that provided as part of bail handles 201 (increased axial height).

Figure 34:
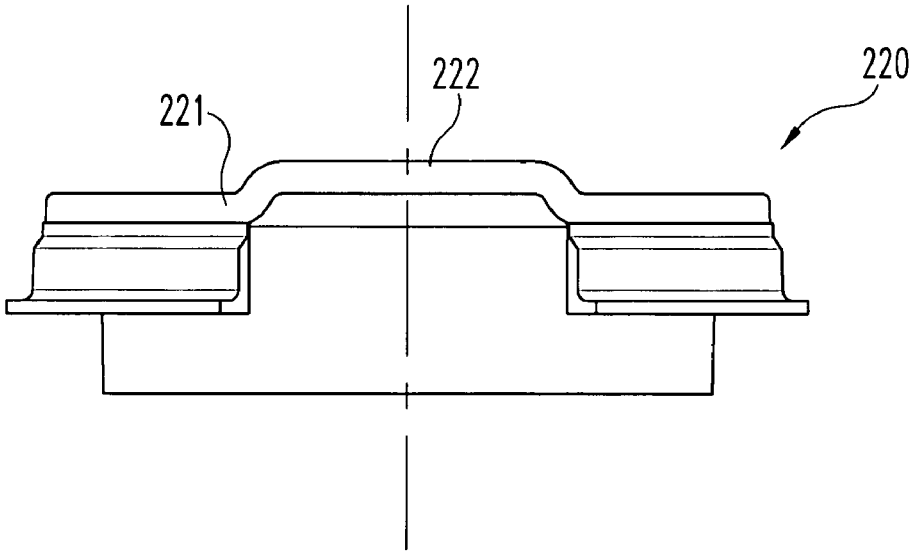
FIG. 34 is a front elevational view of another alternative closing cap according to the present invention.
Figure 35:
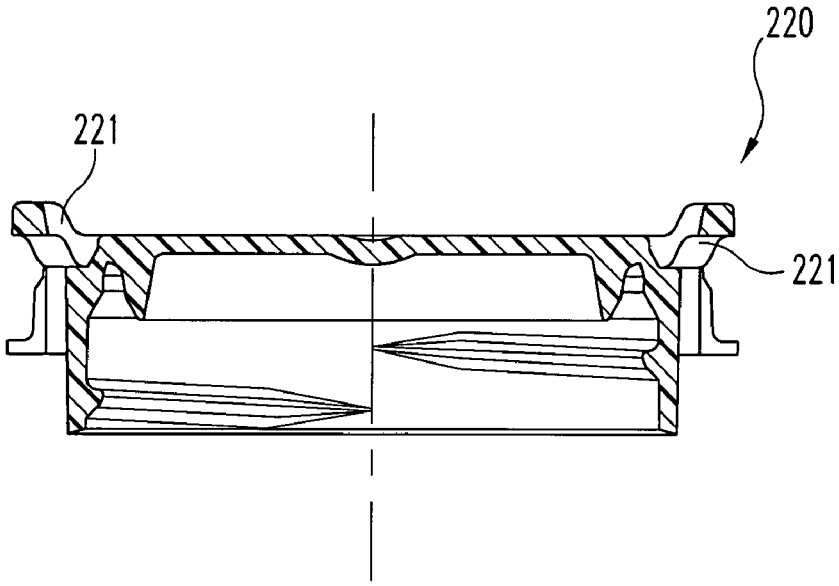
FIG. 35 is a front elevational view, in full section, of the FIG. 34 closing cap as viewed in a plane 90 degrees to the FIG. 34 orientation.

FIGS. 34 and 35 illustrate a unitary, molded plastic closing cap 220 constructed and arranged with a pair of hinged bail handles 221. Except for the specific size, shape, and contours of the bail handles 221, closing cap 220 is constructed and arranged the same as closing cap 23. More specifically, each bail handle 221 is shaped with a center section 222 that is more rectangular than convex. In other words, the curved upper surface seen as part of the original disclosure for closing cap 23 and for closing cap 140 is replaced with a substantially flat upper surface and sides that are more flat than curved.

Figure 36:
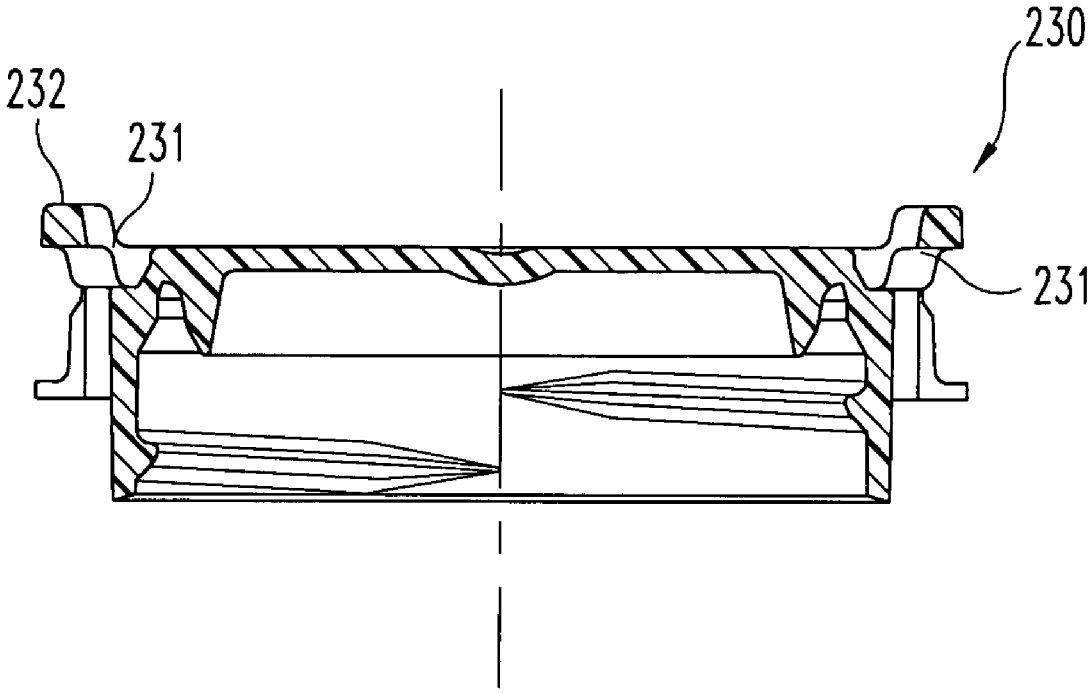
FIG. 36 is a front elevational view, in full section, of another alternative closing cap according to the present invention.

Referring now to FIG. 36, another variation to closing cap 220 is provided by closing cap 230. The bail handles 231 of closing cap 230 are identical to bail handles 221 of closing cap 220, except that the upwardly and outwardly inclined shape of the center section 222 is more upright than with center section 220.

Figure 37:
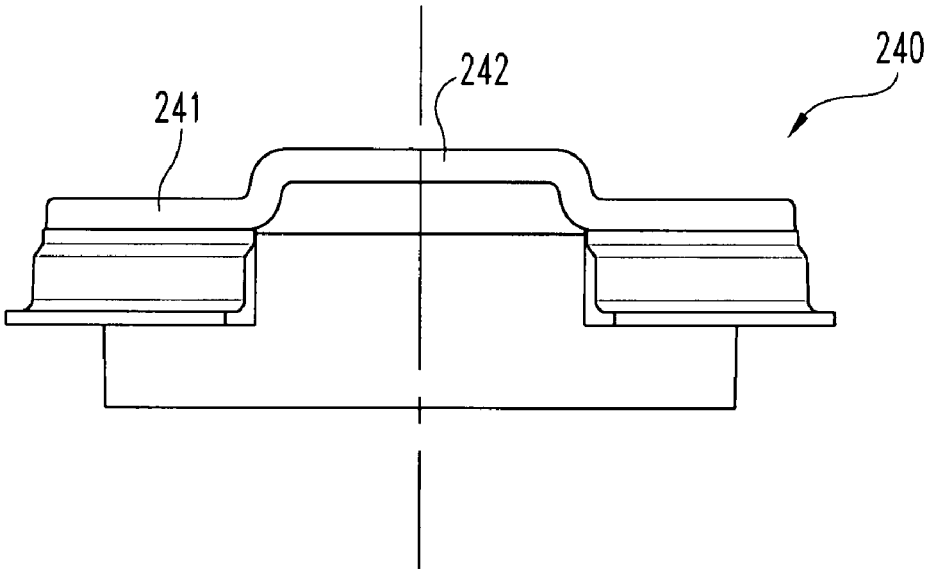
FIG. 37 is a front elevational view of another alternative closing cap according to the present invention.
Figure 38:
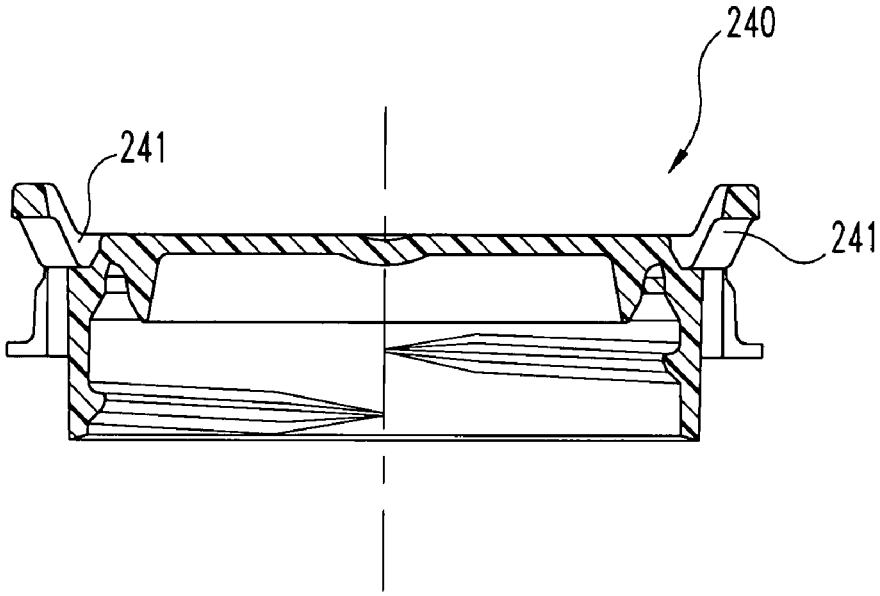
FIG. 38 is a front elevational view, in full section, of the FIG. 37 closing cap as viewed in a plane 90 degrees to the FIG. 37 orientation.

Referring to now to FIGS. 37 and 38, a further variation to closing cap 220 is provided by closing cap 240. The bail handles 241 of closing cap 240 are identical to bail handles 221 of closing cap 220, except that the overall axial height of center section 242 relative to the upper surface of the closing cap 240 is higher than that of center section 222 relative to the upper surface of closing cap 220.

Figure 39:
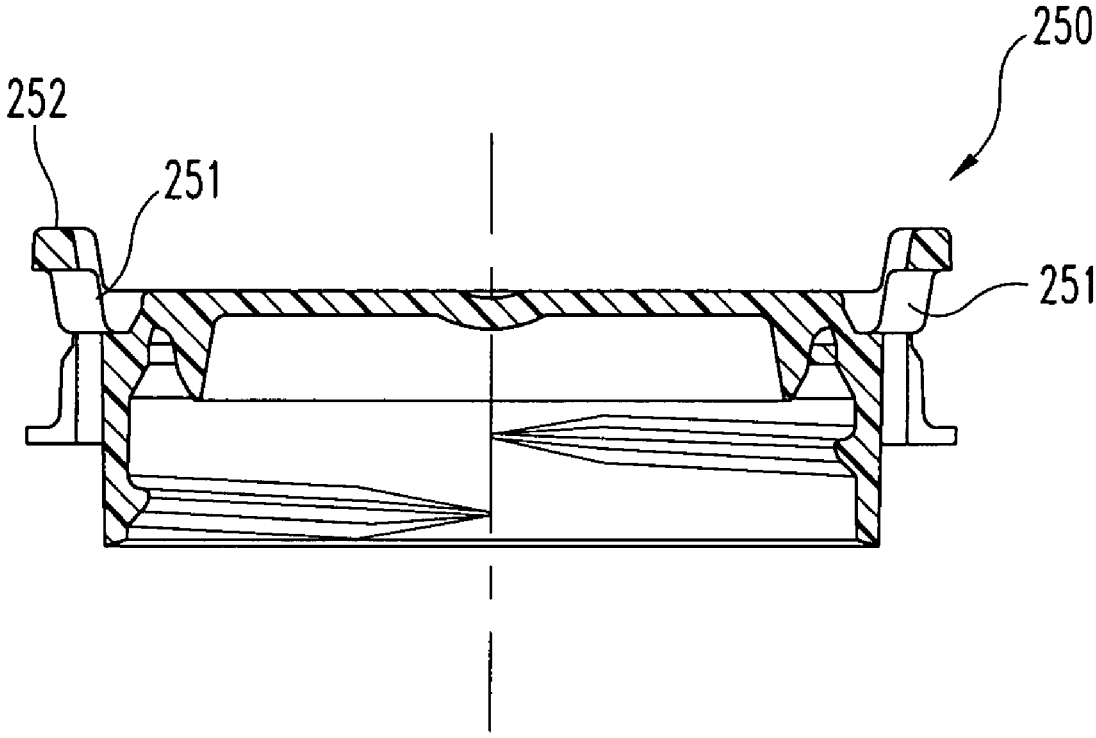
FIG. 39 is a front elevational view, in full section, of another alternative closing cap according to the present invention.

Referring to FIG. 39, a further variation to closing cap 220 is provided by closing cap 250. The bail handles 251, including center section 252, incorporate both of the two prior design modifications. These include the design modification provided as part of bail handles 231 (more upright inclined angle) and that provided as part of bail handles 241 (increased axial height).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A unitary threaded closing cap for a closure comprising:

a body including a sidewall and a top panel; and at least one bail handle unitarily joined to said body and being constructed and arranged to be lifted from a close condition to a raised position, said at least one bail handle being arranged in three sections, including a contoured intermediate section and opposing end sections, the contoured intermediate section including a raised portion that extends above said top panel when said at least one bail handle is in said closed condition, said raised portion including an undersurface which cooperates with said body to define a clearance space therebetween when said at least one bail handle is in said closed condition.

2. The closing cap of claim 1 which further includes a second bail handle unitarily joined to said body and being constructed and arranged to be lifted from a close condition to a raised position, said second bail handle being arranged in three sections, including a contoured intermediate section and opposing end sections, the contoured intermediate section including a raised portion that extends above said top panel when said second bail handle is in said closed condition, said raised portion including an undersurface which cooperates with said body to define a clearance space therebetween when said at least one bail handle is in said closed condition.

3. The closing cap of claim 2 wherein a first end of each bail handle is commonly joined to a first hinge section.

4. The closing cap of claim 3 wherein a second end of each bail handle is commonly joined to a second hinge section.

5. The closing cap of claim 2 wherein the undersurface of said raised portion of each bail handle is concave.

6. The closing cap of claim 2 wherein the undersurface of said raised portion of each bail handle is straight.

7. The closing cap of claim 6 wherein each opposing end section and said intermediate section of each bail handle is connected by a ramp section.

8. The closing cap of claim 7 wherein each ramp section is straight and inclined.

9. The closing cap of claim 2 which further includes a first tamper-evident member unitarily formed as part of each bail handle between the intermediate sections of each bail handle.

10. The closing cap of claim 9 which further includes a second tamper-evident member unitarily formed as part of each bail handle between the intermediate sections of each bail handle.

11. The closing cap of claim 10 wherein a first end of each bail handle is commonly joined to a first hinge section.

12. The closing cap of claim 11 wherein a second end of each bail handle is commonly joined to a second hinge section.

13. In combination:

a closure for a container, said closure including an extendable spout and an outer portion constructed and arranged for attachment to said container; and a unitary threaded closing cap for a closure comprising:

a body including a sidewall and a top panel; and at least one bail handle unitarily joined to said body and being constructed and arranged to be lifted from a close condition to a raised position, said at least one bail handle being arranged in three sections, including a contoured intermediate section and opposing end sections, the contoured intermediate section including a raised portion that extends above said top panel when said at least one bail handle is in said closed condition, said raised portion including an undersurface which cooperates with said body to define a clearance space therebetween when said at least one bail handle is in said closed condition.

14. The combination of claim 13 wherein said extendable spout is externally threaded for receipt of said threaded closing cap.

15. The combination of claim 13 which further includes a second bail handle unitarily joined to said body and being constructed and arranged to be lifted from a close condition to a raised position, said second bail handle being arranged in three sections, including a contoured intermediate section and opposing end sections, the contoured intermediate section including a raised portion that extends above said top panel when said second bail handle is in said closed condition, said raised portion including an undersurface which cooperates with said body to define a clearance space therebetween when said at least one bail handle is in said closed condition.

16. The combination of claim 15 which further includes a first tamper-evident member unitarily formed as part of each bail handle between the intermediate sections of each bail handle.

17. The combination of claim 16 which further includes a second tamper-evident member unitarily formed as part of each bail handle between the intermediate sections of each bail handle.

18. In combination:

a container having a wall portion defining an opening;

a closure for said container, said closure including an extendable spout and an outer portion constructed and arranged for attachment to said container;

a retainer securing said closure to said container wall portion; and a unitary threaded closing cap for a closure comprising:

a body including a sidewall and a top panel; and at least one bail handle unitarily joined to said body and being constructed and arranged to be lifted from a close condition to a raised position, said at least one bail handle being arranged in three sections, including a contoured intermediate section and opposing end sections, the contoured intermediate section including a raised portion that extends above said top panel when said at least one bail handle is in said closed condition, said raised portion including an undersurface which cooperates with said body to define a clearance space therebetween when said at least one bail handle is in said closed condition.

19. The combination of claim 18 which further includes a second bail handle unitarily joined to said body and being constructed and arranged to be lifted from a close condition to a raised position, said second bail handle being arranged in three sections, including a contoured intermediate section and opposing end sections, the contoured intermediate section including a raised portion that extends above said top panel when said second bail handle is in said closed condition, said raised portion including an undersurface which cooperates with said body to define a clearance space therebetween when said at least one bail handle is in said closed condition.

20. The combination of claim 19 which further includes a first tamper-evident member unitarily formed as part of each bail handle between the intermediate sections of each bail handle.

21. The combination of claim 20 which further includes a second tamper-evident member unitarily formed as part of each bail handle between the intermediate sections of each bail handle.

22. The combination of claim 21 wherein said retainer includes an inner wall and wherein as initially assembled a portion of each tamper-evident member is positioned adjacent said inner wall.

* * * * *